US006220637B1

(12) United States Patent
Kierl

(10) Patent No.: US 6,220,637 B1
(45) Date of Patent: Apr. 24, 2001

(54) SNAP FASTENER AND INTERLOCKING TAB

(75) Inventor: William G. Kierl, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/298,896

(22) Filed: Apr. 26, 1999

(51) Int. Cl.[7] ..... E05C 19/06

(52) U.S. Cl. ..... 292/87; 292/80; 292/81; 292/DIG. 38

(58) Field of Search ..... 292/80, 152, 303, 292/DIG. 38, 87, 89, 81, 91, 107, DIG. 11; 220/326, 835, 833; 429/97, 96; 24/614–616

(56) References Cited

U.S. PATENT DOCUMENTS

| | | | | |
|---|---|---|---|---|
| 3,092,885 | * | 6/1963 | Guanche | 24/614 X |
| 3,947,932 | * | 4/1976 | Flynn | 24/616 |
| 4,520,537 | * | 6/1985 | Valikov | 24/616 |
| 4,811,469 | | 3/1989 | Rise | 24/664 |
| 4,879,883 | * | 11/1989 | Bruner | 63/15.7 |
| 5,100,015 | * | 3/1992 | Vanderstuyf | 220/326 |
| 5,123,541 | * | 6/1992 | Giannini et al. | 206/600 |
| 5,137,260 | * | 8/1992 | Pehr | 215/216 |
| 5,231,740 | * | 8/1993 | Mohebkhosravi | 24/616 |
| 5,272,795 | * | 12/1993 | Rothstein | 24/616 |
| 5,295,602 | * | 3/1994 | Swanson | 220/306 |
| 5,440,792 | * | 8/1995 | Ida | 24/615 |
| 5,607,792 | | 3/1997 | Garcia et al. | 429/97 |
| 5,634,675 | * | 6/1997 | Mo | 292/80 |
| 5,832,573 | * | 11/1998 | Howell | 24/616 X |
| 6,076,237 | * | 6/2000 | Goorhouse | 24/614 X |

* cited by examiner

*Primary Examiner*—Teri Pham Luu
(74) *Attorney, Agent, or Firm*—Dale W. Dorinski

(57) ABSTRACT

Two parts (120, 160) can be mated and secured from relative movement in three different orthogonal directions or planes by the use of a novel, two piece, plastic fastener structure. The snap fastener has an integral interlocking tab (170) that serves to constrain the movement in a third direction or plane. The snap fastener additionally consists of an operative component (110) and a securing component (150). The operative component has a resilient member (112) that deforms to receive a catch member (152) on the securing component when the operative component and the securing component are snapped or mated together. One of the two components contains an opening (180), while the other contains a body portion shaped more or less like a tab or tongue which is capable of being inserted within the opening when the two components are mated. When so inserted, the relative movement of the two components is restricted in three directions, without the use of a remotely located securing means.

8 Claims, 3 Drawing Sheets

SNAP FASTENER AND INTERLOCKING TAB

TECHNICAL FIELD

This invention relates in general to latching devices, and more particularly to a quick release fastener.

BACKGROUND

Traditionally, when snap fits are used to secure two pieces or devices together, two or more snap fits are used, along with some sort of alignment means situated somewhere on the two parts, remote from the snap fits. This is because all prior art snap fits only constrain the movement of the two parts relative to one another in one direction, or two directions at most. That is, the snap fit restricts the relative movement of the two pieces in only the X or Z direction, or at most, in both the X and Z directions, but never in all three possible directions (X, Y, and Z). Because of this, a traditional snap fit can be easily undone simply by moving one or both of the individual pieces in a direction normal to the direction in which the snap fit was actuated. Thus, designers have been forced to employ an additional securing means, such as retainer pins, cams, pivots, hinges, etc. at a location that is remote from the snap fit, or to employ two or more snap fits. Clearly, this creates a number of undesirable design constraints on products. As an example, portable electronic devices, such as two-way radios and telephones, often have removable battery packages for supplying power. In many such configurations, a removable battery package is secured to a host electronic device by a latch system. The latch system ordinarily includes a portion situated on the battery package, and a portion situated on the host device that mate together to secure the battery package to the host device. When a user removes the battery package from the host device for whatever reason, the electrical terminals of the battery package are exposed, and can be inadvertently connected together by a metal object. THIS is not desirable, as shorting the positive and negative terminals of the battery causes rapid heating of the battery and the metal object, and has occasionally led to melting of nearby objects, or even worse, a fire could occur. One means of preventing this has been to provide a cover for the terminals that can be snapped onto the battery package using the same latch system as employed on the host device. Unfortunately, conventional-art latches and snap fits have required an additional securing means, as these snap fits only constrain the relative movement of the two objects in one or two directions. Thus, unless the two objects are somehow constrained from moving in a third direction, even the tightest of snap fits can be easily undone by simply moving the two members in the unconstrained direction. Thus, in order to secure the cover to the battery, an additional constraining means has to be located remotely from the snap fit latch. The astute reader will appreciate that this causes the cover to be larger than necessary, thus increasing the size and cost of the cover, both of which are undesirable.

Thus, a need exists for fasteners of a type as herein described which can be inexpensively manufactured and which may be easily and conveniently released as desired.

DETAILED DESCRIPTION OF THE PREFERRED EMBODIMENT

The fact that the terms "snap fastener", "snap fit", "clasp", "latch" or "snap clip" can be used in describing a structure in accordance with this invention indicates that there is some degree of confusion and inconsistency in the manner in which these terms are used. This ambiguity in connection with the meaning of mechanical terms is characteristic of much of the terminology in the mechanical art. Presumably this is a result of the gradual expansion and change of technology over a prolonged time period. In spite of the incredibly long duration of the field of the invention it is believed that a need still exists for new and improved fasteners of the type to which this invention pertains. To that end, I have created a novel snap fastener that allows two parts to be mated and secured from relative movement in three different orthogonal directions or planes. The snap fastener has an interlocking tab that serves to constrain the movement in a third direction or plane. The snap fastener additionally consists of an operative component and a securing component. The operative component has a resilient member that deforms to receive a catch member on the securing component when the operative component and the securing component are snapped or mated together. One of the two components also has a tab, while the other component contains an opening to receive the tab when the two components are mated. After the connection is made, the relative movement of the two components is restricted in three directions, without the use of a remotely located securing means.

Figure 1:
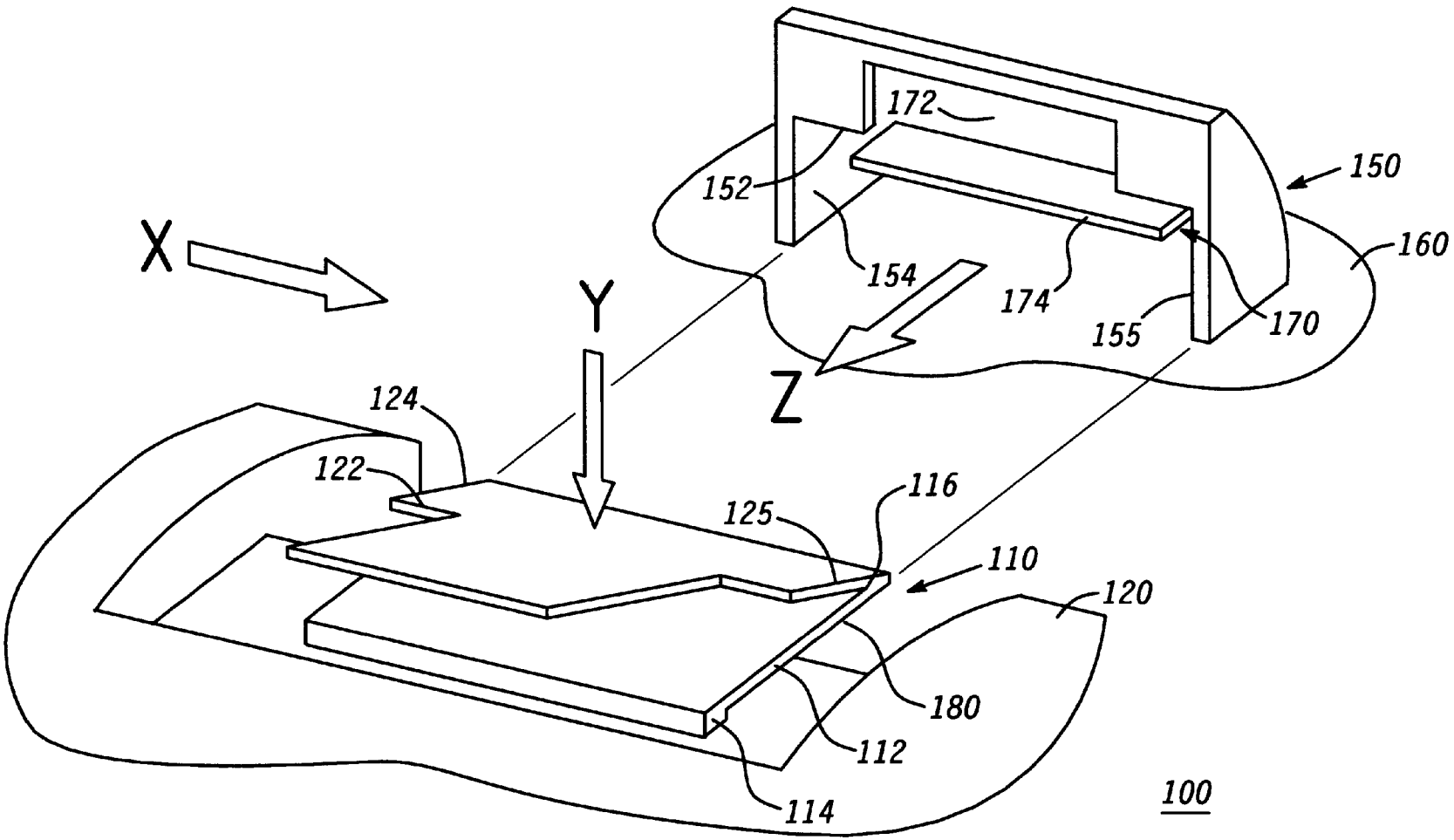
FIG. 1 is a isometric view of one embodiment of a snap fit that constrains in three directions, in accordance with the present invention, prior to assembly.

While the specification concludes with claims defining the features of the invention that are regarded as novel, it is believed that the construction, method of operation and advantages of the invention will be better understood from a consideration of the following description in conjunction with the drawing figures, in which like reference numerals are carried forward. Referring now to FIG. 1, we see an isometric view of one embodiment of a snap fastener system 100, which consists of an operative component 110 that co-operates with and is received by a securing component 150. The operative component 110 has a resilient member 112 that is arranged so that one end 114 is fixed to a base 120 of the operative component and a second end 116 is free to move under pressure. When sufficient force is provided in the downward direction (as represented by arrow "Y") onto the resilient member, it deflects out of it's rest position into a deflected position. Once the force is removed, resilient member 112 moves back toward its original position. The securing component 150 is also secured to it's own base 160, and contains a catch member 152 that is arranged to be received by a portion 122 (shaped, for example, like a shoulder) of the resilient member 112 when the securing component is mated to the operative component in a direction represented by the "Z" arrow. In addition, the securing component 150 also contains a tab or protrusion 170 that is fixed at one end 172 to the base 160, while the other end 174 remains unattached. The tab 170 can, of course, assume numerous shapes, only one of which is shown in the drawing figures. The reader of ordinary skill in the art will appreciate that the tab can assume cross-sectional shapes of square, rectangular, oval, round, tubular, conical, triangular, or irregular, and still fall within the metes and bounds of my invention. Corresponding to this tab is an opening or cavity 180 underneath the resilient member 112 on the operative component. This opening 180 is arranged to receive the tab 170 when the two components are mated.

Figure 2:
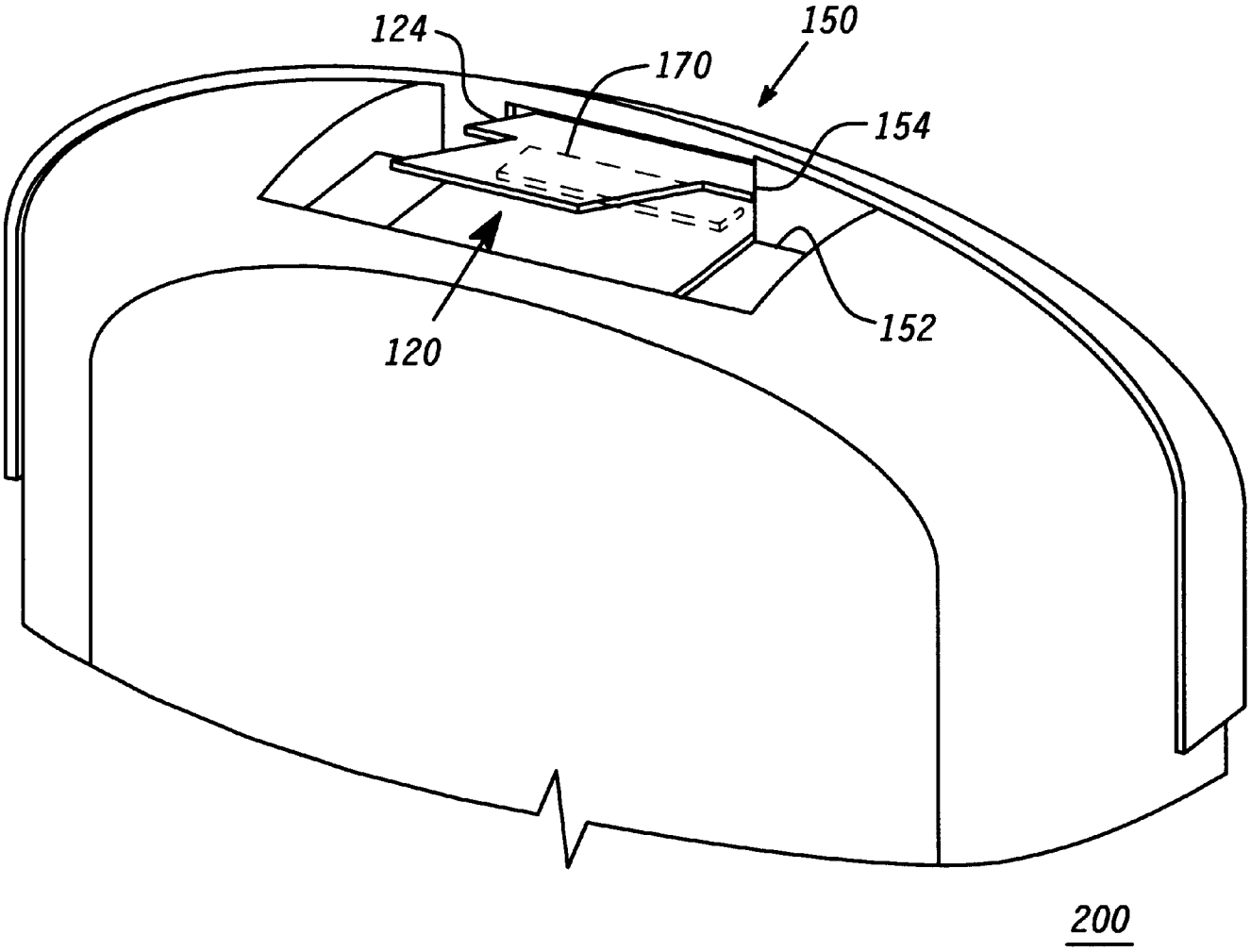
FIG. 2 is a isometric view of the device shown in FIG. 1, after assembly.
Figure 3:
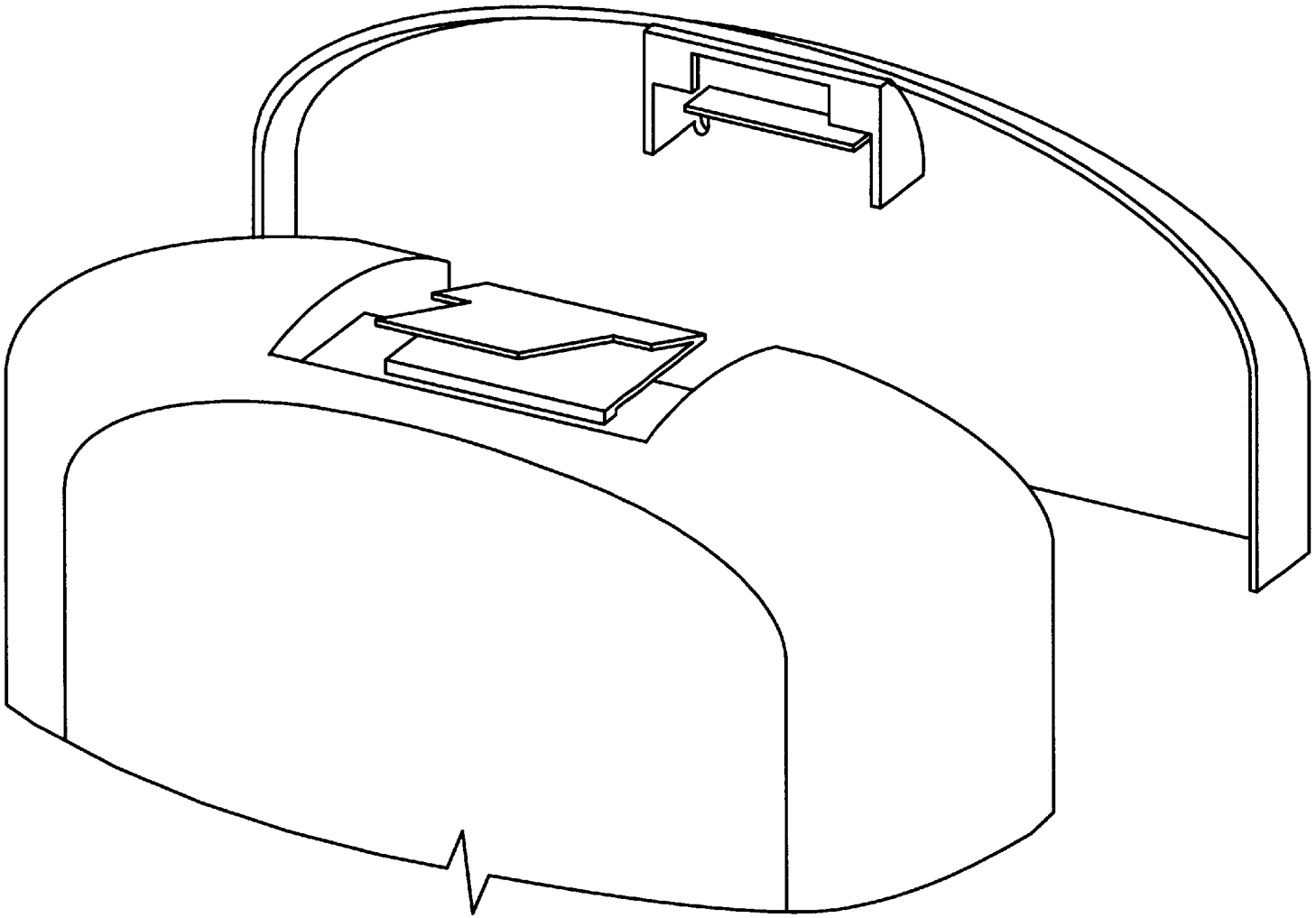
FIG. 3 is an isometric view of the snap fit shown in FIG. 2, in the unmated position.

Having described the structure in detail, a description of how my novel snap fastener works will now be provided by referring to both FIGS. 1 and 2. As the securing component 150 is mated to the operative component 120 by moving the two components toward each other in the "Z" direction, the catch member 152 begins to ride up onto the resilient member 112. The free end 174 of the tab 170 slides under the resilient member 112 and is captured in the opening 180, thus constraining the two components from moving in the "Y" direction. Continued movement in the "Z" direction causes the catch member 152 to deflect the resilient member 112 downward. Ultimately, the catch member rides past the shoulder 122 of the resilient member, and the resilient member 112 snaps up (in the opposite "Y" direction). This completes the mating operation, and the user is provided with an audio and tactile feedback that the fastener is mated by the sound and movement of the resilient member 112 snapping back into its rest position. The two components are now tightly held together and are constrained from moving in three orthogonal directions (as represented by the "X", "Y", and "Z" arrows). The securing component is constrained from moving in the "Z" direction relative to the operative component by the engagement of the catch member 152 on the shoulder 122. Depending on the construction, the two components are further constrained from moving in the "X" direction by the abutment of the sidewalls 154, 155 against the respective edges 124, 125 of the resilient member 112. The constraint in the third orthogonal direction (represented by the "Y" arrow) is provided by the engagement of the tab 170 into the opening 180. The combination of engagements provided by the various members serves to constrain relative movement in three orthogonal directions, with all the constraining members being located in the securing component and the operative component. This is in stark contrast to the prior art devices that have a pivot or catch remotely located from the snap portions.

To release the two components from each other, the user pushes the resilient member 112 downward in the "Y" direction, while at the same time pulling the two components apart in the opposite of the "Z" direction.

Preferably, the two components are made from a plastic material having the appropriate resilient properties. However, one may just as easily construct one or both of the components from other materials, such as metal, or use plastic filled with carbon, mineral, or glass fillers. Various alternative embodiments of the invention can be easily envisioned by one skilled in the art. For example, while the drawing figures depict the resilient member as a two cantilever beams that are folded onto one another, other versions of cantilever beams can be used, such as a single beam or a triple beam. Additionally, one can employ other types of conventional snap fits, however, the snap fits must contain my additional constraining member in order to restrict movement in a third direction. Another alternate embodiment finds the tab affixed to the operative component, and the corresponding opening to receive the tab is then located on the securing component. One application of this novel snap fastener with interlocking tab is to incorporate it into a cover that can be snapped onto a battery package to protect the electrical terminals, using the same latch system as employed on the battery package. The additional constraining means is now part of the snap fit, instead of being located remotely from the snap fit latch. This permits the new cover to be smaller than those used in the prior art, thus reducing the size and cost of the cover.

In summary, the present invention provides significant benefits. The snap fastener with interlocking tab provides a reliable, rugged and easily operable mechanism that can be molded into nearly any type of package that has two parts that need to be removably fitted together. The two parts are easily assembled to provide a highly manufacturable, cost effective system. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A snap fastener with an interlocking tab, comprising:

an operative component and a securing component;

the operative component having a deformable cantilever beam rigidly affixed to a base, the cantilever beam deforming to receive a catch member on the securing component when the operative component and the securing component are mated to form a snap fastener, such that the cantilever beam and the catch member constrain the relative movement of the two components in two directions that are orthogonal to each other;

a cavity under the operative component, one wall of the cavity comprising the base and an opposite wall of the cavity comprising the deformable cantilever beam;

the securing component having a protrusion adapted to fit into an open end of the cavity, so that when the operative component and the securing component are mated the relative movement of the two components is constrained by the two cavity walls in a third direction that is orthogonal to said two directions that are orthogonal to each other.

2. The snap fastener as described in claim 1, wherein the operative component is a part of a battery package for a portable electronic device.

3. The snap fastener as described in claim 2, wherein the securing component is a cover for the battery package.

4. The snap fastener as described in claim 1, wherein both components are formed of plastic.

5. The snap fastener as described in claim 1, wherein the cantilever beam is sufficiently deformable to release the operative component from the securing component.

6. The snap fastener as described in claim 1, wherein the third direction is perpendicular to the direction of mating.

7. A snap fastener with an interlocking tab, comprising:

an operative component comprising:

a first cantilever beam having a fixed end and a free end, the fixed end rigidly attached to a base of the operative component;

a second cantilever beam having a fixed end attached to the free end of the first cantilever beam and having a free end disposed above the fixed end of the first cantilever beam;

the free end of the second cantilever beam having one or more shoulders; and a cavity between the first cantilever beam and the base of the operative component, said cavity arranged to have an opening at the free end of the first cantilever beam and further arranged such that the first cantilever beam forms one wall of the cavity and the base of the operative component forms an opposite wall of the cavity;

a securing component for receiving the operative component, the securing component having a catch member and a tab;

wherein a releasable snap fit is formed when the operative component is mated with the securing component, the catch member engaging said one or more shoulders to restrict relative movement of the two components in no more than two orthogonal directions, and the tab interlocking in the cavity such that the two walls of the cavity restrict relative movement of the two components in a third orthogonal direction.

8. A plastic snap fastener with an interlocking tab, comprising:

a monolithic operative component formed of plastic, comprising:

a deformable first cantilever beam having a fixed end and a free end, the fixed end rigidly attached to a base of the operative component;

a second cantilever beam having a fixed end attached to the free end of the first cantilever beam and having a free end disposed above the fixed end of the deformable first cantilever beam;

the free end of the second cantilever beam having one or more shoulders; and a cavity between the deformable first cantilever beam and the base of the operative component, said cavity arranged to have an opening at the free end of the first cantilever beam and further arranged such that the deformable first cantilever beam forms one wall of the cavity and the base of the operative component forms an opposite wall of the cavity;

a securing component, formed of plastic, for receiving the operative component, the securing component having a catch member and a tab;

wherein a releasable snap fit is formed when the operative component is mated with the securing component, the deformable cantilever beam deforming so that said one or more shoulders engage the catch member to restrict relative movement of the two components in no more than two orthogonal directions, and the tab interlocking in the cavity such that the two walls of the cavity restrict relative movement of the two components in a third orthogonal direction.

* * * * *